US007051414B2

(12) United States Patent
Swanson

(10) Patent No.: US 7,051,414 B2
(45) Date of Patent: May 30, 2006

(54) METHOD OF RETAINING COMPONENTS STRUNG ON A BEAD WIRE

(76) Inventor: Jack C. Swanson, 4939 E. Chestnut Dr., Claremore, OK (US) 74017

( * ) Notice: Subject to any disclaimer, the term of this patent is extended or adjusted under 35 U.S.C. 154(b) by 92 days.

(21) Appl. No.: 10/868,588

(22) Filed: Jun. 15, 2004

(65) Prior Publication Data

US 2005/0274016 A1 Dec. 15, 2005

(51) Int. Cl.
*B23P 19/04* (2006.01)

(52) U.S. Cl. ..... 29/433; 29/896.4; 24/131 R; 24/549; 24/550; 267/166; 267/69; 248/682

(58) Field of Classification Search ..... 29/433, 29/896; 24/131 R, 131 C, 129 C, 548, 549, 24/550; 248/213, 682, 687, 51, 312, 692, 248/303, 302

See application file for complete search history.

(56) References Cited

U.S. PATENT DOCUMENTS

| | | | | | |
|---|---|---|---|---|---|
| 356,315 | A * | 1/1887 | Hunt | 211/120 |
| 635,121 | A * | 10/1899 | Bostrom | 211/120 |
| 862,024 | A * | 7/1907 | Senf | 248/229.26 |
| 1,325,807 | A * | 12/1919 | Siemann | 248/541 |
| 1,466,339 | A * | 8/1923 | Plante | 396/652 |
| 2,456,302 | A * | 12/1948 | Mocnik | 248/468 |
| 2,462,464 | A * | 2/1949 | Brier et al. | 248/51 |
| 2,630,316 | A | 3/1953 | Foster | |
| 2,887,815 | A * | 5/1959 | Courtright | 43/42 |
| 3,613,897 | A * | 10/1971 | Filler | 211/120 |
| 3,675,275 | A * | 7/1972 | Arblaster | 248/75 |
| 3,883,934 | A * | 5/1975 | Rochfort | 248/65 |
| 4,893,788 | A * | 1/1990 | Chave | 256/47 |
| 5,553,822 | A * | 9/1996 | Barnard et al. | 248/302 |
| 6,575,972 | B1 * | 6/2003 | Gordon | 606/54 |

OTHER PUBLICATIONS

Hemostat Serrated Clamp [online], 2 Bead or not 2 Bead Apr. 4, 2004 [retrieved Nov. 9, 2005], Retrieved from the Internet: <URL: www.2beadornot2bead.com>.*

DIN 2097 Ausschuss Federn im Deutytschen Normen ausschuss (DNA) German.

* cited by examiner

*Primary Examiner*—George Nguyen
*Assistant Examiner*—Christopher M. Koehler
(74) *Attorney, Agent, or Firm*—Robert E. Massa

(57) ABSTRACT

The method of easily and securely retaining components strung on a bead line by placing a portion of the bead line between coil members of a tension spring comprises applying torque action to leverable members of the tension coil between the thumb and index finger of the user's hand to spread apart contiguous coil members of the spring, placing a portion of the bead line between a pair of coil members which had been spread apart, releasing the torque action from the leverable members, and allowing coil members to close and securely maintain the portion of bead line in position on the coil spring in a manner to resist removal therefrom.

12 Claims, 2 Drawing Sheets

METHOD OF RETAINING COMPONENTS STRUNG ON A BEAD WIRE

FIELD OF THE INVENTION

My invention relates to a method of quickly and easily protecting components strung on a bead wire during preparation of a necklace to prevent those components from accidental removal. My invention further relates to a method of permitting an artist-craftsman to retain components positioned on a beaded portion of a necklace in proper position during preparation or to permit an artist-craftsman to safely and conveniently protect components on separate bead lines during preparation of a necklace.

BACKGROUND OF THE INVENTION

I had initially, many years ago, invented my basic coil spring device for a completely different field of use, and I have very recently have had unexpectedly great success with my coil spring device in the present field of endeavor, the field of jewelry design and construction, by providing an artist-craftsman who produces various items of necklace designs with an important greatly useful means of protecting the safety and stability of his ornamentation.

I immediately recognized a completely new field of use for my earlier invention when I became familiar with the art and hobby of designing and producing jewelry necklace articles, those ornamental jewelry products which are comprised of a multitude of small components which are placed on a string or fine wire for decorative purposes.

The artist-craftsman who engages in designing and constructing a beaded necklace is always faced with the disconcerting and frustrating problem of seeing many or all of the components placed on a necklace line suddenly and quickly slide off the line at the least accidental action or inaction, or slipping from hand, perhaps destroying a unique and complicated design.

To my knowledge, there has never been any simple device in use, which was easily and quickly attachable to a bead line to protect the intricate design from such destruction.

An artist-craftsman prepares a necklace by carefully string beads, or various decorative components, on a suitable necklace line, and must always be aware of the care with which the work must be done in order to prevent accidental destruction of his work by untoward slippage of components from the line.

Also, there is no device currently available to serve as a means of protecting the bead line from accidental loss during a period of rest by the artist-craftsman, or during a time of unexpected interruption. I have found out that the ease and convenience with which my tension spring device can be applied makes it ideal for quick and temporary placement on a bead line.

My invention, which I refer to as a bead stopper, can be very quickly and easily applied to a bead line, and will hold the line extremely securely between a pair of coil members of the coil spring because of the high tension which the coil spring possesses.

When I recognized the need for my device in the field to which my coil spring suddenly appealed, and developed my method of use and began actual manufacture and sale of my invention, I have had unusual overnight success with the popularity and demand for my invention. I have had orders from all over the country. I have had to appear at various trade shows on behalf of necklace hobbyists, and have been approached by manufacturer's representatives seeking agency rights upon hearing of my invention.

When I had developed my coil spring for another different purpose, I had become aware of the following published references:

U.S. Pat. No. 2,630,316 Foster, Edwin E. issued Mar. 3, 1953 DIN 2097 Ausschuss Federm im Deutschen Normenausschuss Mai 1973

Foster describes a coil spring device of much larger structure than my invention and which is intended for a totally different use. The Foster spring is described as a "Constant Compression Spring". Foster states in Column 2: "As shown in FIG. 2, movement of the trunnions 13 and 14 toward one another, while the coils 10 are free to move laterally, results in equal resistance or load throughout a wide movement of the trunnions 13 and 14 toward one another" for a "compression" force. Also, the German reference describes a coil spring in FIG. 14 in which the loops are oriented in an opposite direction from those of my device. The result of the opposite orientation would produce a torque completely different from my coil spring and leverage of a completely different value or convenience.

SUMMARY OF THE INVENTION

The primary object of my invention is to provide a method of maintaining components on a line, which is easy to use, convenient, and comprising simple components.

Another object of my invention is to provide a method of easily and securely retaining components strung on a line by cooperating simple components.

Another object of my invention is to provide a method of easily and securely retaining components strung on a bead line by means of cooperation of bead line with a tension spring.

Another object of my invention is to provide a method of retaining components on a bead line by the capability of easily and quickly placing a tension spring security member where it is needed most acutely.

DESCRIPTION OF THE PREFERRED EMBODIMENTS

Figure 1:
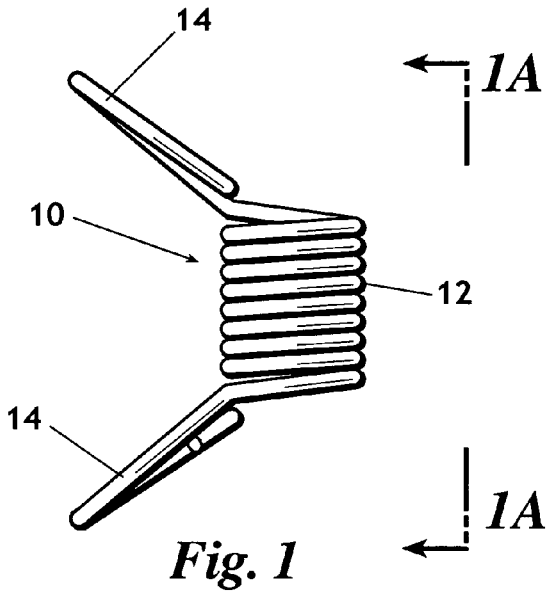
FIG. 1 is a side view of a coil spring member in a relaxed condition as it would be adaptable for use in a method according to my invention.

In FIG. 1 I show a form of tension spring 10, generally, in a relaxed position, as it would be prior to engagement with a bead line in performing the method of my invention. Tension spring 10, generally, is shown as a coil spring, and comprises a multiplicity of coil members 12, with loop members 14, generally, extending contiguously from coil members 12 from each end of the spring member 10, generally.

I have designed my coil spring member 10, generally, to be adaptable to cooperate with a typical or common bead line as is used for various necklace designs and structures.

A necklace might be a single flexible string or wire, or might be comprised of a plurality of strings or wires. In either case, I have become aware that the tension spring is ideal for this use because the spring can be attached very quickly and easily at any position on the string or wire and will remain securely in place.

As an artist-craftsman is placing various components on a bead line, those components are loosely in place, without any formidable stop member applied to the line. Thus, a slight accident or slip will allow many or all of the components to slide quickly from the line.

For the most common type of necklace, I have found that the most suitable dimensions of the spring 10, generally, would be: over-all length of about 3 to 4 centimeters; each coil 10, generally, made of wire of a diameter of about 1 millimeter; each coil member of a diameter of about 1 centimeter; and each loop member 14 having a diameter of about 1.5 to 2.0 centimeters, preferably of a diameter chosen for a most comfortable size, most conveniently for the easiest grasping by the person designing the necklace.

As I show in FIG. 1, loop members 14 extend outwardly at an angle of from 120 to 150 degrees from coil members 12, in order to provide the greatest leverage action with the most adequate amount of torque. For example, if loop members 14 were 20 positioned angularly directly over the coil members 12, the device would not be capable of proper manipulation, and would be extremely difficult to operate.

Figure 1A:
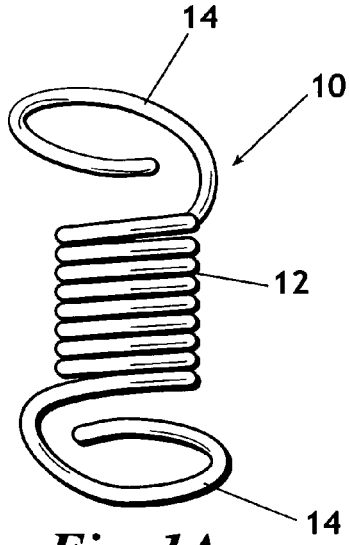
FIG. 1A is a front view of a coil spring member as described in FIG. 1 along the lines 1A—1A in FIG. 1.
Figure 3:
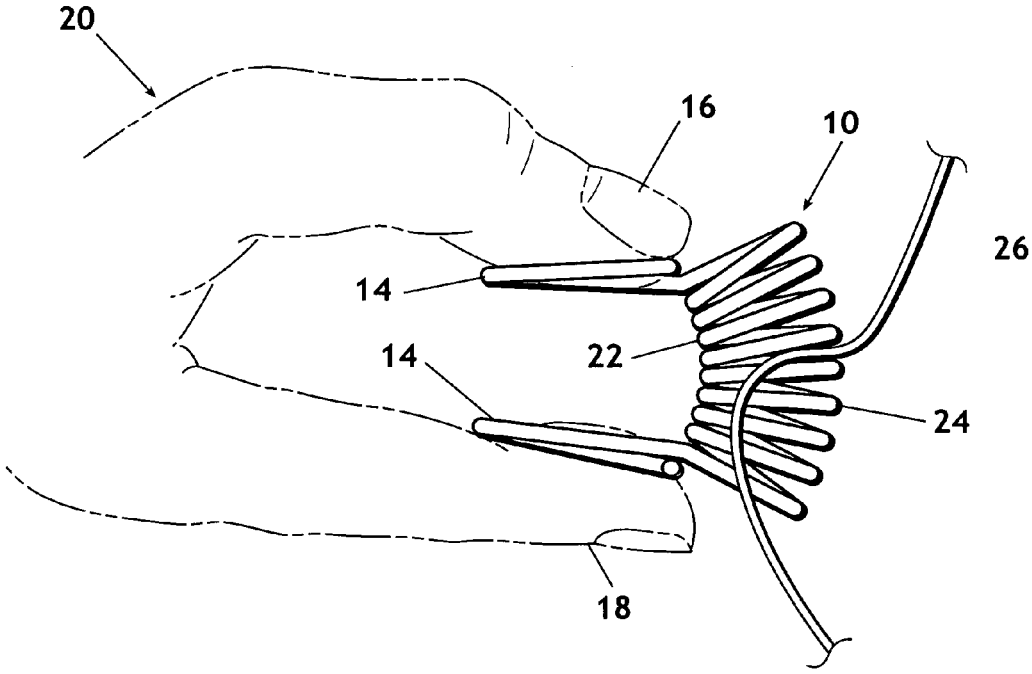
FIG. 3 is a side view of a coil spring being placed under tension between a person's fingers, shown in shadow, with coil spring having a portion of a bead line placed therein.

In FIG. 1A, I have shown the manner in which spring 10, generally, is oriented in order to describe clearly the manner in which loop members 14 are to be held between a thumb 16 and index finger 18, generally, of a person's hand 20, generally, as engagingly shown in FIG. 3, as person is squeezing loop members 14 toward each other in order to provide leverage on a first side 22 of coil members 12 to provide a space 24 on an opposite side of coil members 12, to permit the placing of a string 26 of a necklace within a space between two coil members 12. Thus, in FIG. 3, strong tension is being applied to loop members 14. This action describes the easy manner in which the bead stopper may be quickly grasped and easily spread apart to be quickly applied on a bead line where it is most needed.

Figures 2, 4:
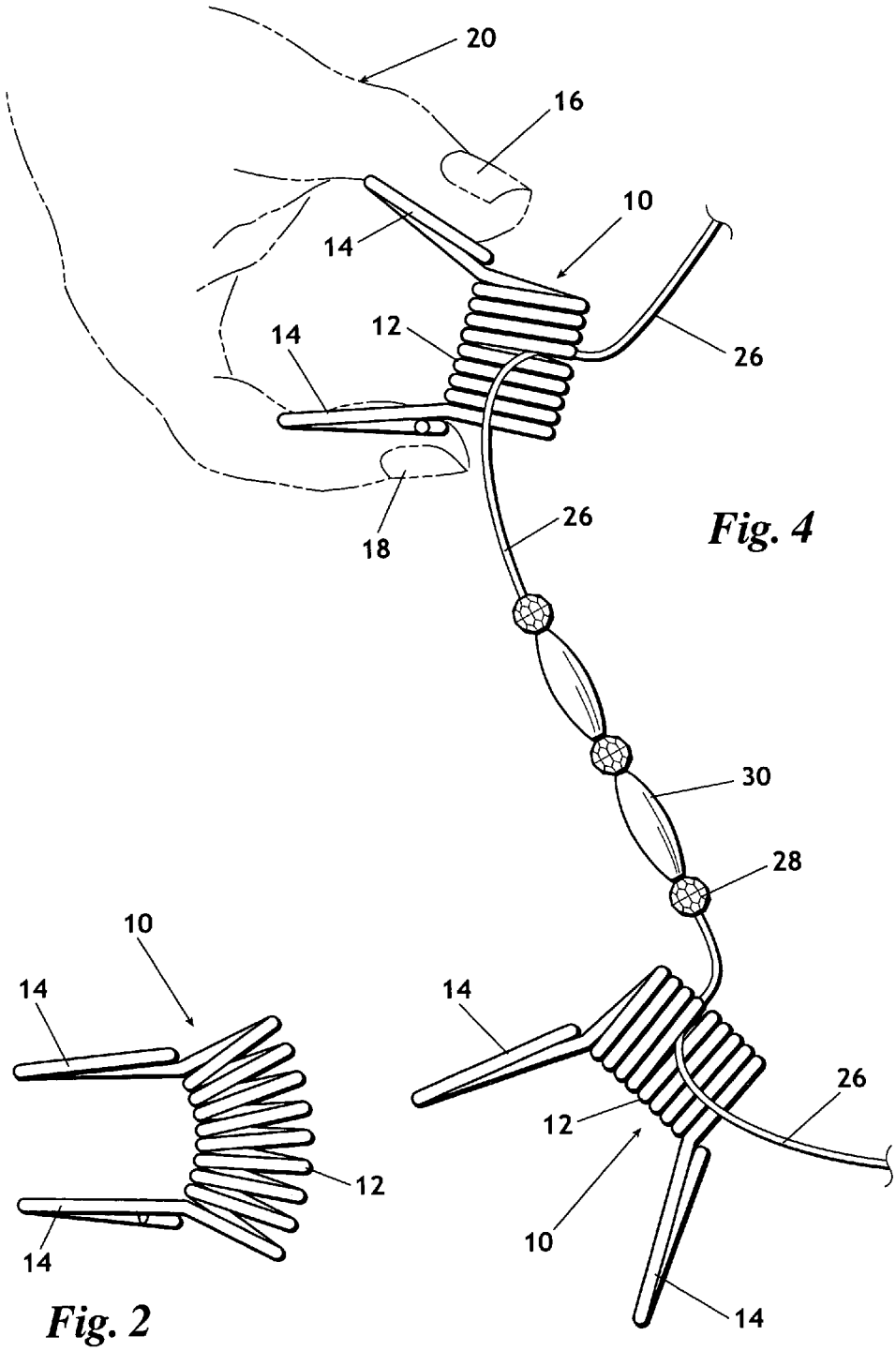
FIG. 2 is a side view of a coil spring retaining member according to my invention as it would be placed in a tensionable condition preparatory for securing to a bead line according to my invention.
FIG. 4 is a side view of a pair of coil spring members placed in relaxed position on a bead line with a person's fingers shown in shadow.

Then, in FIG. 4 I show an advanced method of use of my bead retaining method by showing a bead line having a number of bead components 28 and 30, already in position; and a person having just relaxed a second spring member 10 at a second location farther along string 26, generally, in position to retain bead components 28 and securely thereon. In FIG. 4, I refer to bead components 28 and 30, but these may also include any type of ornamental components, which may be strung on string 26 in performing the method of my invention.

Therefore, since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. The method of retaining components strung on a bead line by placing a portion of the bead line between adjacent coil members of a helical coil tension spring, which method comprises:

grasping leverable members of the coil spring between a thumb and finger, applying torque action to the leverable members by action of thumb and finger to spread apart coil members on side of coil spring opposite leverable members, placing a portion of bead line between open coil members, releasing torque action from leverable members, and allowing coil members to close and securely maintain portion of bead line in position in relation to tension force of the coil spring.

2. The method of retaining components strung on a bead line as described in claim 1, in which:

adjacent coil members are initially in contact with each other.

3. The method of retaining components strung on a bead line as described in claim 2, in which:

leverable components comprise integral coil members at each end of the spring, with each leverable components oriented in a plane at an angle to the axis of the coil spring.

4. The method of retaining components strung on a bead line as described in claim 3, in which:

leverable components are oriented at a substantial grasping angle for grasping between user's thumb and finger.

5. The method of retaining components strung on a bead line as described in claim 4, in which:

portion of bead line maintained on the spring is a portion near an end of the bead line.

6. The method of retaining components strung on a bead line as described in claim 5, in which:

portion of bead line maintained on the spring is a portion beyond last component string on the line.

7. The method of retaining components strung on a bead line as described in claim 6, in which:

preferred dimensions of the coil spring include an overall length between extensions of leverable components of at least three centimeters.

8. The method of retaining components strung on a bead line by cooperation with a coil tension spring which comprises:

placing a helical tension spring having a plurality of coil members in operable position, grasping leverable loop components at ends of the spring between thumb and index finger, applying force to the loop members by action of the thumb and index finger to produce a lever action by coil members along one side of the spring to spread apart coil members along opposite side of spring, placing a portion of bead line between a pair of coil members being spread apart, relaxing the loop members from the force of the thumb and index finger, and allowing coil members to close and securely maintain portion of bead line in position between coil members.

9. The method of retaining components strung on a bead line as described in claim 8, in which:

the loop members comprise contiguous coil members extending outwardly from the same side of the spring at a suitable grasping angle.

10. The method of retaining components strung on a bead line as described in claim 9 in which:

The coil spring is formed of flexible stainless steel to secure a portion of bead line with suitable high tension.

11. The method of retaining components strung on a bead line as described in claim 10, in which:

the portion of bead line maintained on the spring is a portion near an end of the bead line.

12. The method of retaining components strung on a bead line as described in claim 10, in which:

the portion of bead line maintained on the spring is a portion beyond last component strung on the line.

* * * * *